US006706125B2

(12) United States Patent
Kimura et al.

(10) Patent No.: US 6,706,125 B2
(45) Date of Patent: Mar. 16, 2004

(54) LINEAR SHAPE STEEL EXCELLENT IN JOINT FATIGUE CHARACTERISTICS AND PRODUCTION METHOD THEREFOR

(75) Inventors: Tatsumi Kimura, Okayama (JP); Yasushi Morikage, Chiba (JP); Keniti Amano, Okayama (JP); Takanori Okui, Okayama (JP); Keizou Taoka, Okayama (JP); Hironori Miura, Okayama (JP); Hiroyuki Ookubo, Okayama (JP); Fumimaru Kawabata, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 51 days.

(21) Appl. No.: 10/018,881

(22) PCT Filed: Apr. 23, 2001

(86) PCT No.: PCT/JP01/03436

§ 371 (c)(1),
(2), (4) Date: May 6, 2002

(87) PCT Pub. No.: WO01/81642

PCT Pub. Date: Nov. 1, 2001

(65) Prior Publication Data

US 2002/0192012 A1 Dec. 19, 2002

(30) Foreign Application Priority Data

Apr. 24, 2000 (JP) ..... 2000-122323
May 26, 2000 (JP) ..... 2000-156273

(51) Int. Cl.[7] ..... C22C 38/02; C22C 38/04

(52) U.S. Cl. ..... 148/320; 403/52

(58) Field of Search ..... 403/52; 148/320

(56) References Cited

FOREIGN PATENT DOCUMENTS

| | | |
|---|---|---|
| GB | 2 082 490 | 3/1982 |
| JP | 51-27850 | 3/1976 |
| JP | 57-44414 | 3/1982 |
| JP | 60-200913 | 10/1985 |
| JP | 5-5127 | 1/1993 |
| JP | 7-124602 | 5/1995 |
| JP | 9-195268 | 7/1997 |
| JP | 9-287020 | 11/1997 |
| JP | 11-172328 | 6/1999 |
| JP | 2001-170702 | 6/2001 |

*Primary Examiner*—Deborah Yee
(74) *Attorney, Agent, or Firm*—Young & Thompson

(57) ABSTRACT

When manufacturing a straight steel section having a joint 2 comprising a ball claw 21 and a curved claw 20 by hot-rolling a bloom vertically symmetrically to make a section blank having a flange 2A at a web 1 end (first step), vertically asymmetrically hot-rolling the section blank to adjust the size of the web and form the flange into a rough joint 2B including a projection 20A (second step), and subjecting the projection to hot bend rolling into a curved claw 20 (third step), wherein the bloom has a chemical composition comprising, in mass percentage, from 0.01 to 0.20% C, up to 0.8% Si, up to 1.8% Mn, up to 0.030% P, and up to 0.020% S; and therein the claw bending start temperature in the third step is a temperature of over $Ar_3$ or up to $Ar_3$-50° C., thereby achieving a depth of wrinkle flaws 10 present on the inner surface side of the curved claw of up to 0.5 mm.

4 Claims, 14 Drawing Sheets

LINEAR SHAPE STEEL EXCELLENT IN JOINT FATIGUE CHARACTERISTICS AND PRODUCTION METHOD THEREFOR

TECHNICAL FIELD

The present invention relates to a straight steel section excellent in joint fatigue property. More particularly, the invention relates to a straight steel section used for connecting component members used for forming a civil engineering structure, and among others, applied to members required to have a satisfactory joint fatigue property, and a manufacturing method thereof.

BACKGROUND ART

A straight steel section has, as shown in FIG. 1, a joint 2 comprising a curved claw 20 and a ball claw 21 at the both ends of a straight web 1. The bag-shaped space surrounded by the curved claw 20 and the ball claw 21 is called a joint pocket 22, and the exit thereof is called a joint opening 23. When connecting two straight steel sections together to form a joint, the ball claw 21 of a straight steel section is inserted into the joint pocket 22 of the other straight steel section.

Rolling (hot rolling) favorable for productivity, particularly caliber rolling using caliber rolls is commonly adopted for manufacturing straight steel sections.

FIG. 2 is a caliber system diagram illustrating a typical caliber rolling process of a straight steel section. As shown in FIG. 2, the straight steel section is usually manufactured through a first step for preparing a section blank having flanges 2A at the both ends of the web 1 by rolling vertically symmetrically a bloom through, for example, calibers K14 to K11, a second step for rolling vertically asymmetrically the section blank through, for example, calibers K10 to K3 to adjust dimensions (width and thickness) of the web 1 and forming the flange A into a rough joint 2B having a projection 20A and a ball claw 21, and a third step for finishing the rough joint 2B into a joint 2 by forming a curved claw 20 by pressing and bending the projection 20A onto the anti-web side through, for example, calibers K2 and K1 (this is called the "claw bending").

FIG. 3 is a layout drawing illustrating a typical caliber rolling equipment corresponding to FIG. 2. In this example, the calibers K14 to K11 are allocated to a blooming mill (BM mill); the calibers K10 to K7, to a breakdown mill (BD mill); the calibers K6 to K4, to an intermediate mill (S1 mill); and the calibers K3 to K1, to a finishing mill (SF mill). The section blank manufactured in the first step is usually left to cool to near room temperature, then reheated and subjected to hot rolling in the second and subsequent steps.

The claw bending process through the calibers K2 and K1 is illustrated in FIG. 4. As shown in FIG. 4, claw bending is conducted through changes in the gap between the upper and lower rolls along with the progress of rolling. In FIG. 4, the reference numeral 20B represents a bent portion during deformation from the projection 20A into the curved claw 20.

The straight steel section manufactured by this process gives a very high productivity and is mass-producible as compared with a straight steel section manufactured by the hot extrusion forming process, and thus provides a remarkable merit of stable supply at a low cost.

For the purpose of smoothing traffic for alleviation of traffic jam in cities, overhead crossing of railroads with roads is now promoted. Grade separation of crossing includes an underpass in which a road passes under a railroad and an overpass in which the road passes over the railroad. With a view to reducing the construction period and the cost in the underpass process, a process using straight steel sections (JES (Jointed Element Structure) process) is attracting the general attention. Details of this process are shown in FIG. 5. This is a tunnel wall building process for installing a new road tunnel 30 under a railroad 60. In this process, asymmetric connecting elements 400, each comprising two asymmetric connecting element members 4 and a connecting plate 41 welded together in staple shape, are sequentially connected through engagement of joints 40 and 40, thus permitting easy construction of a structure 300 (the tunnel wall frame, in this case), not requiring separate preparation of construction scaffold. It is attracting the general attention as a process favorable in period and cost aspects. The asymmetric connecting element member 4 can be manufactured by cutting the straight steel section in FIG. 1 at the width center of the web 1 thereof, turning one of the cut portions upside down, and welding a separately prepared flat plate in between.

DISCLOSURE OF INVENTION

When manufacturing a straight steel section, as described above, a curved claw is formed in the third step of the caliber rolling process. Upon bending the claw, wrinkle flaws 10 are formed on the inner surface of the curved claw 20 as shown in FIG. 6.

Such wrinkle flaws have never posed a problem. More specifically, a straight steel section has usually a relatively small joint thickness as up to about 16 mm (for the evaluated site, see FIG. 1). Produced wrinkle flaws have as well a small depth, and this sufficiently ensures a required static tensile strength. This is why wrinkle flaws have not been considered to pose any problem.

However, as is suggested by the structural element member in the aforementioned JES process, there is a tendency toward requiring a higher joint strength. To meet such a demand, it is necessary to use a joint thickness larger than the conventional one. In this case, there occurs a larger contraction of the inner surface of the curved claw upon claw bending, leading to an increase in the wrinkle flaw depth. When applied to a structural member in which a cyclic stress acts on the joint, the wrinkle flaws present on the claw inner surface exert a notch effect, and this results in a problem of deterioration of the fatigue life. That is, at every passage of a train on the rail, the load thereof repeatedly acts particularly on the upper slab of the railroad, so that engagements of joints 40 of asymmetric connecting element member, among others, are susceptible to fatigue. As a result, a straight steel section used for this purpose is required to be excellent in fatigue property in the joint, particularly in the curved claw. The relationship between wrinkle flaws and fatigue property has not however as yet been clarified.

The present invention has therefore an object to the extent of wrinkle flaws not affecting fatigue property, and to provide a straight steel section which permits reduction of wrinkle flaws produced on the inner surface of the joint and is excellent in joint fatigue property and a manufacturing method thereof.

The present inventors carried out studies for the purpose of improving joint fatigue property of a straight steel section, and found measures to reduce the wrinkle flaw depth on the inner surface of the joint throughout the entire rolling process of straight steel sections, a chemical composition satisfying strength and weldability requirements as a connecting element member, and the relationship with rolling and bending-forming conditions permitting reduction of the wrinkle flaw depth, thus completing the present invention. The gist of the invention is as follows:

(1) A straight steel section excellent in joint fatigue property, having a joint comprising a flat web and a ball claw and a curved claw at the both ends in the width direction thereof, wherein wrinkle flaws present on the inner surface of the curved claw have a depth of 0.5 mm or less.

(2) A straight steel section excellent in joint fatigue property according to (1) above, having a chemical composition comprising, in mass percentage, from 0.01 to 0.20% C, 0.8% or less of Si, 1.8% or less of Mn, 0.030% or less of P, and 0.020% or less of S, and the balance Fe and incidental impurities.

(3) A straight steel section excellent in joint fatigue property according to (1) above, having a chemical composition comprising, in mass percentage, from 0.01 to 0.20% C, 0.8% or less of Si, 1.8% or less of Mn, 0.030% or less of P, and 0.020% or less of S, and in addition, one or more selected from the following groups 1 to 3:

(group 1) one or more selected from the group consisting of 1.0% or less of Cu, 1.0% or less of Ni, 1.0% or less of Cr, 0.5% or less of Mo, 0.10% or less of V, 0.10% or less of Nb, and 0.005% or less of B;

(group 2) 0.1% or less of Al; and (group 3) one or more selected from the group consisting of 0.10% or less of Ti, 0.010% or less of Ca, and 0.010% or less of REM, and the balance Fe and incidental impurities; wherein the carbon equivalent Ceq defined by the following formula (1):

$$Ceq=C+Si/24+Mn/6+Ni/40+Cr/5+Mo/4+V/14 \quad (1)$$

where each of element symbols on the right side: content of the element (mass %);

is 0.45% or less.

(4) A straight steel section excellent in joint fatigue property according to any one of (1) to (3) above, which is used in a tunnel wall frame member for constructing a road under a railroad.

(5) A manufacturing method of a straight steel section excellent in joint fatigue property, having a joint comprising a flat web and a ball claw and a curved claw at the both ends in the width direction thereof, comprising a first step for hot rolling a bloom vertically symmetrically to make a section blank having a flange at a web end, a second step for hot-rolling the section blank vertically asymmetrically to adjust the size of the web and form the flange into a rough joint including a projection, and a third step for finishing the rough joint into a joint by hot-bend-rolling the projection into a curved claw; wherein the bloom has a chemical composition comprising, in mass percentage, from 0.01 to 0.20% C, 0.8% or less of Si, 1.8% or less of Mn, 0.030% or less of P, and 0.020% or less of S; and wherein the claw bending start temperature in the third step is a temperature of over $Ar_3$ or $Ar_3$-50° C. or below.

(6) A manufacturing method of a straight steel section excellent in joint fatigue property according to (5) above, wherein the claw bending end temperature in the third step is 700° C. or more.

(7) A manufacturing method of a straight steel section according to (5) or (6) above, wherein the flange outer surface of the section blank is smoothed in cold during the interval between the first step and the second step.

(8) A manufacturing method of a straight steel section according to (7) above, wherein the smoothing treatment is carried out so that the smoothed surface has a surface roughness Rmax of 20 $\mu$m or less.

REFERENCE NUMERALS

Figure 1:
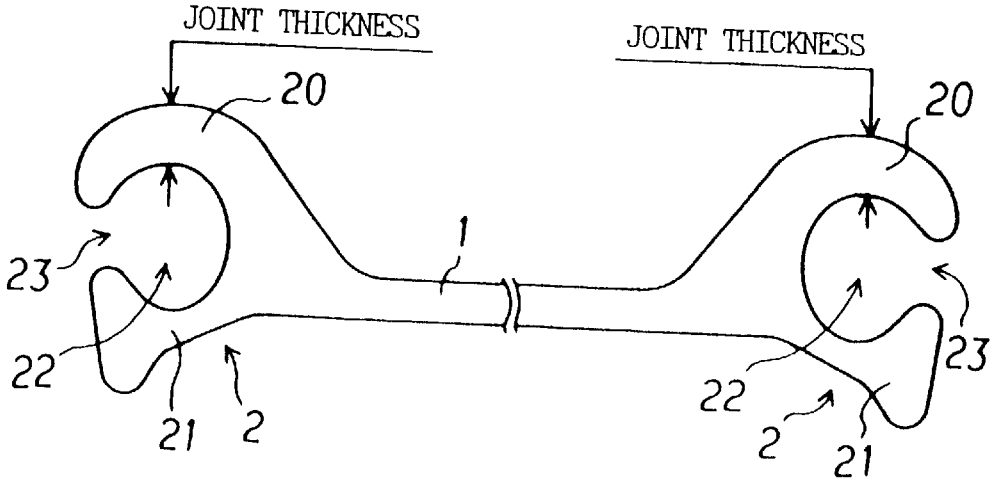
FIG. 1 is a sectional view illustrating the joint shape of a straight steel section.

1 Web
2 Joint
2A Flange
2B Rough joint
3 Flange outer surface
4 Asymmetric connecting element member
7 Test piece
10 Wrinkle flaw
20 Curved claw
20A Projection
21 Ball claw
22 Joint pocket
23 Joint opening
30 Road tunnel
40 Joint
41 Connecting plate
50 Punch

50S Opening

51, 52 Supporting seat

60 Railroad

300 Structure (tunnel wall frame)

400 Asymmetric connecting element

BEST MODE FOR CARRYING OUT THE INVENTION

Embodiments of the present invention will now be described, including the process of development of the invention.

First, the effect of wrinkle flaws produced upon bending the claw on fatigue property of a joint of a straight steel section will be considered.

Figure 7:
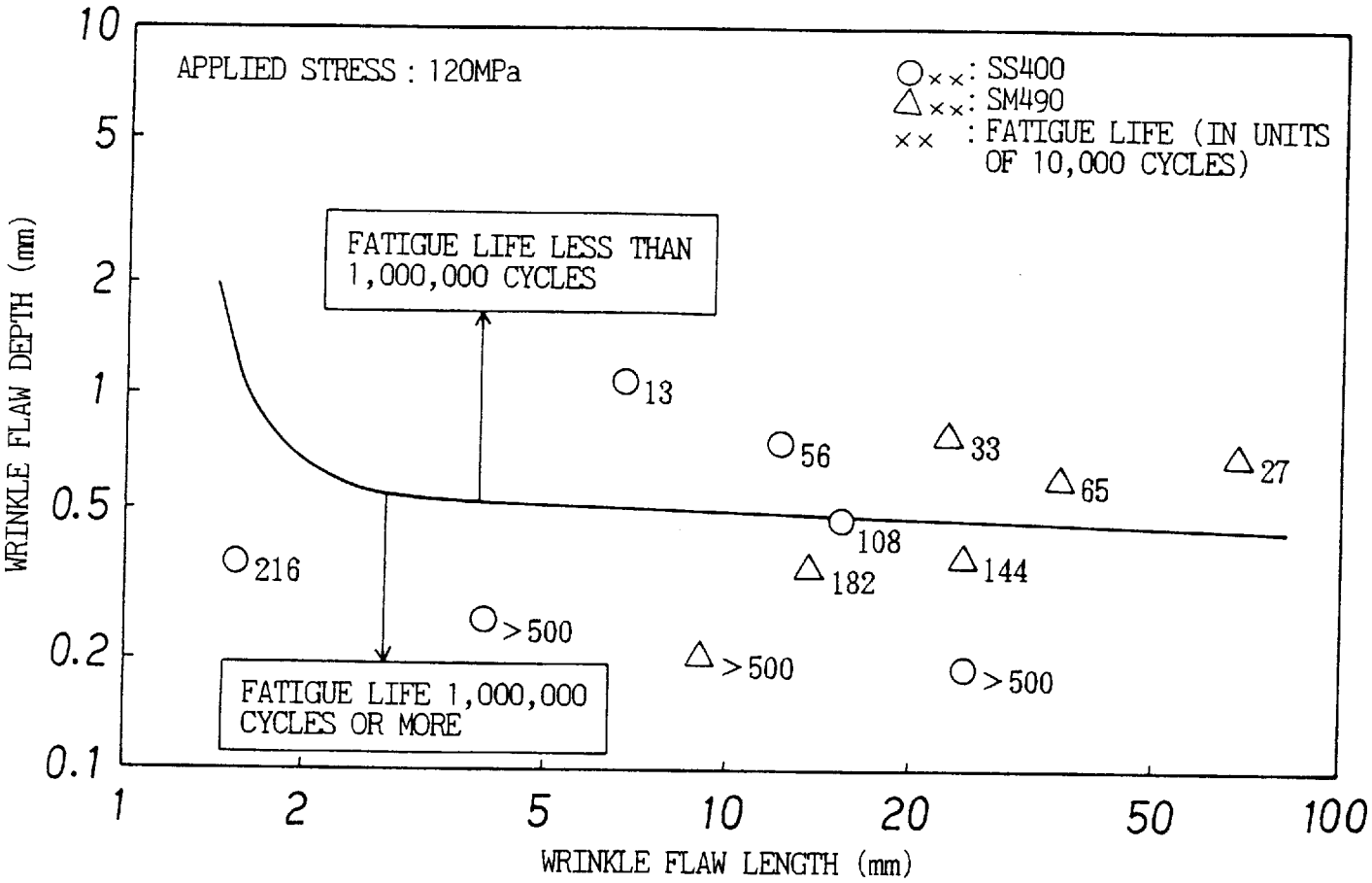
FIG. 7 is a graph illustrating the effect of wrinkle flaw size on fatigue property.

FIG. 7 is a graph illustrating the effect of the wrinkle flaw size on fatigue property. FIG. 7 represents the result of measurement of the fatigue life before fracture in a fatigue test carried out on a joint of a straight steel section having a TS (tensile strength) within a range of from 400 to 570 MPa under an applied stress of 120 MPa. The result of a theoretical calculation of the length and depth of wrinkle flaws permitting achievement of a fatigue life of a million cycles is also plotted.

The theoretical calculation was based on K-value during a fatigue test calculated in accordance with the stress expanding coefficient (K-value) formula specified in WES 2805-1997, giving attention to the change in stress expanding coefficient resulting from the presence of wrinkle flaws. In this case, the stress acting on the inner surface of the curved claw under an applied stress of 120 MPa was analyzed by FEM (finite element method) (result of analysis: 380 MPa), to determine a K-value with wrinkle flaw length and depth as parameters. On the other hand, ΔKth (a critical value between growth and non-growth of cracks: cracks grow when K-value is larger than ΔKth) and da/dN (amount of growth of cracks per fatigue test) were determined through experiments. The wrinkle flaw length and depth permitting achievement of a fatigue life of a million runs were determined on the assumption that fatigue cracks grew from wrinkle flaws by an amount da/dN when K-value is larger than ΔKth.

In FIG. 7, SM400 represents a 0.16%C-0.32%Si-0.65% Mn-0.018% P-0.008%S steel, and SM490 represents a 0.16%C-0.41%Si-1.35% Mn-0.013% P-0.005%S-0.12%Cu-0.015%Nb-0.012% Ti steel (in mass percentage). FIG. 7 suggests that a fatigue life of at least a million cycles is achieved within a region of wrinkle flaw depth of up to 0.5 mm, and that fatigue property is not largely affected by the chemical composition (strength level) of steel. It is also known that fatigue property is hardly affected by the wrinkle flaw length but almost fully dependent on the wrinkle flaw depth within a range of wrinkle flaw length of 2 mm or more. To judge from the result of these considerations, it is necessary to limit the wrinkle flaw depth to 0.5 mm or less. A wrinkle flaw depth of 0.3 mm or less is more preferable because of the extension of the fatigue life to at least two million cycles. The wrinkle flaw depth can be reduced by a method of correction of wrinkle flaws produced on the inner surface of the curved claw by grinding or the like, a method of smoothing treatment of the flange outer surface of the section blank obtained in the first step (described later), or a method of controlling the claw bending temperature in the third step (described later).

As described above, fatigue property of the joint of the straight steel section, while being dependent upon the wrinkle flaw depth on the inner surface of the curved claw, is not largely affected by the chemical composition of steel. It is not therefore necessary to take account of the fatigue property when designing the chemical composition of steel. However, when a straight steel section is used for a connecting element member of the JES process, while the straight steel section suffices to be of the TS400 MPa class for a member with a small amount of landfill and a low static operating stress, the straight steel section must be of the TS570 MPa class for deeper landfill. In this case, although adjustment of strength through a heat treatment is conceivable without changing the chemical composition, a high size accuracy is required because of the complicated shape of the joint as shown in FIG. 1. It was therefore considered necessary to allow addition of alloy elements to some extent and adjust strength through chemical composition not through a heat treatment, if thermal deformation during the heat treatment was taken into account. To prepare for welding operation during manufacture of connecting element members, furthermore, it is also necessary to consider weldability in the design of the chemical composition.

Considering the circumstances as described above, the straight steel section of the present invention has a chemical composition comprising, in mass percentage, from 0.01 to 0.2% C, 0.8% or less of Si, 1.8% or less of Mn, 0.030% or less of P, 0.020% or less of S, and the balance Fe and incidental impurities. The chemical composition may comprise, in weight percentage, from 0.01 to 0.2% C, 0.8% or less of Si, 1.8% or less of Mn, 0.030% or less of P, 0.020% or less of S, one or more selected from the following groups 1 to 3:

(group 1) one or more selected from the group consisting of 1.0% or less of Cu, 1.0% or less of Ni, 1.0% or less of Cr, 0.5% or less of Mo, 0.10% or less of V, 0.10% or less of Nb and 0.005% or less of B;

(group 2) 0.1% or less of Al; and (group 3) one or more selected from the group consisting of 0.10% or less of Ti, 0.010% or less of Ca and 0.010% or less of REM; and the balance Fe and incidental impurities, wherein the carbon equivalent Ceq as defined by the following formula (1):

$$Ceq=C+Si/24+Mn/6+Ni/40+Cr/5+Mo/4+V/14 \quad (1)$$

where, each element symbol on the right side: content of such an element (in mass percentage)

is 0.45% or less.

reasons of limiting the contents of the individual elements will now be described.

C: From 0.01 to 0.2%:

From the point of view of ensuring a satisfactory strength, C must be contained in an amount of 0.01% or more. On the other hand, a C content of over 0.2% impairs weldability. The C content should therefore be within a range of from 0.01 to 0.2%.

Si: 0.8% or Less:

When Al is not added, Si is necessary as a deoxidizer, and contributes to improvement of strength in a solid-solution state in steel. Addition of Si in an amount of over 0.8% causes a decrease in weld HAZ toughness. The upper limit of Si should therefore be 0.8%. The Si content should preferably be within a range of from 0.05 to 0.6%.

Mn: 1.8% or Less:

Mn is an inexpensive element which increases hardenability and strength. An Mn content of over 1.8% however impairs weldability. The Mn content should therefore be 1.8% or less, or preferably, within a range of from 0.5 to 1.6%.

P: 0.030% or Less and S: 0.020% or Less:

Impurities P and S should be reduced as far as possible. The P content should be 0.030% or less, and the S content, 0.020% or less, taking account of the ranges not posing a particular problem as a straight steel section and the cost for dephosphorization and desulfurization.

Apart from the elements described above, as required, it is possible to add one or more of Cu, Ni, Cr, Mo, V, Nb and B mainly for adjusting strength, and/or Al mainly for improving deoxidation efficiency, and/or one or more of Ti, Ca and REM, for improving weld HAZ toughness.

More specifically, when a high-strength material of the SM490 MPa class or the SM570 MPa class is required, it is difficult for C, Si and Mn alone to improve strength and it is desirable to add one or more selected from (group 1) consisting of 1.0% or less of Cu, 1.0% or less of Ni, 1.0% or less of Cr, 0.5% or less of Mo, 0.10% or less of V, 0.10% or less of Nb, and 0.005% or less of B. The upper limits for contents of the individual constituents are set by considering weldability, weld HAZ toughness, and economic merits.

For the purpose of improving the deoxidation efficiency, it is desirable to add (group 2) 0.1% or less of Al, and for improving the deoxidation efficiency, (group 3) one or more of 0.10% or less of Ti, 0.010% or less of Ca and 0.01% or less of REM. The upper limits for the contents of the individual constituents are set by considering cleanliness of steel.

Carbon Equivalent Ceq: 0.45% or Less:

A Ceq of over 0.45% requires preheating upon welding, thus impairing operability. The Ceq is therefore limited to 0.45% or less.

Then, from the point of view of production of wrinkle flaws, claw bending behavior was studied.

Figure 8:
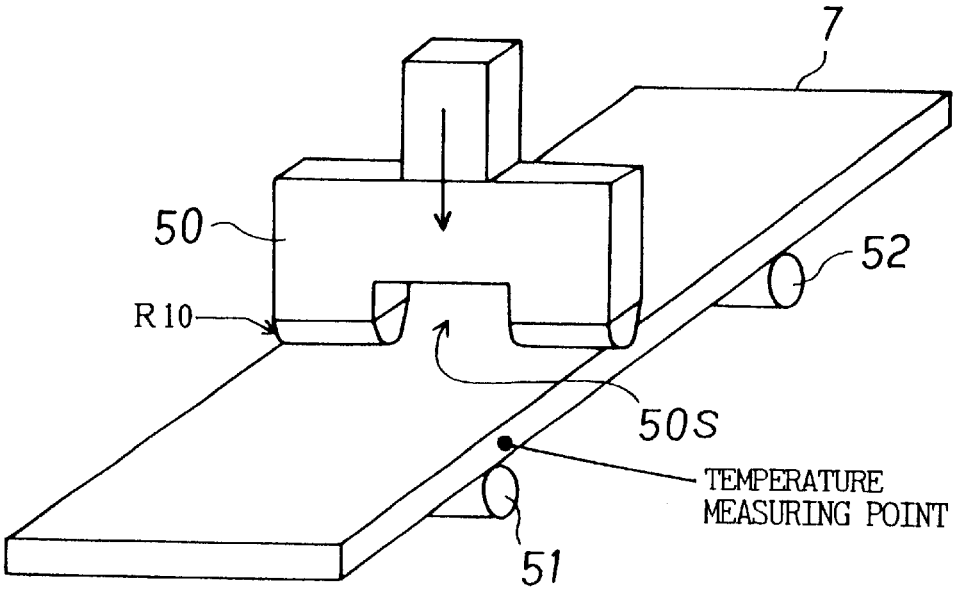
FIG. 8 is a descriptive view illustrating a laboratory experiment method simulating bending on an industrial equipment.
Figure 9:
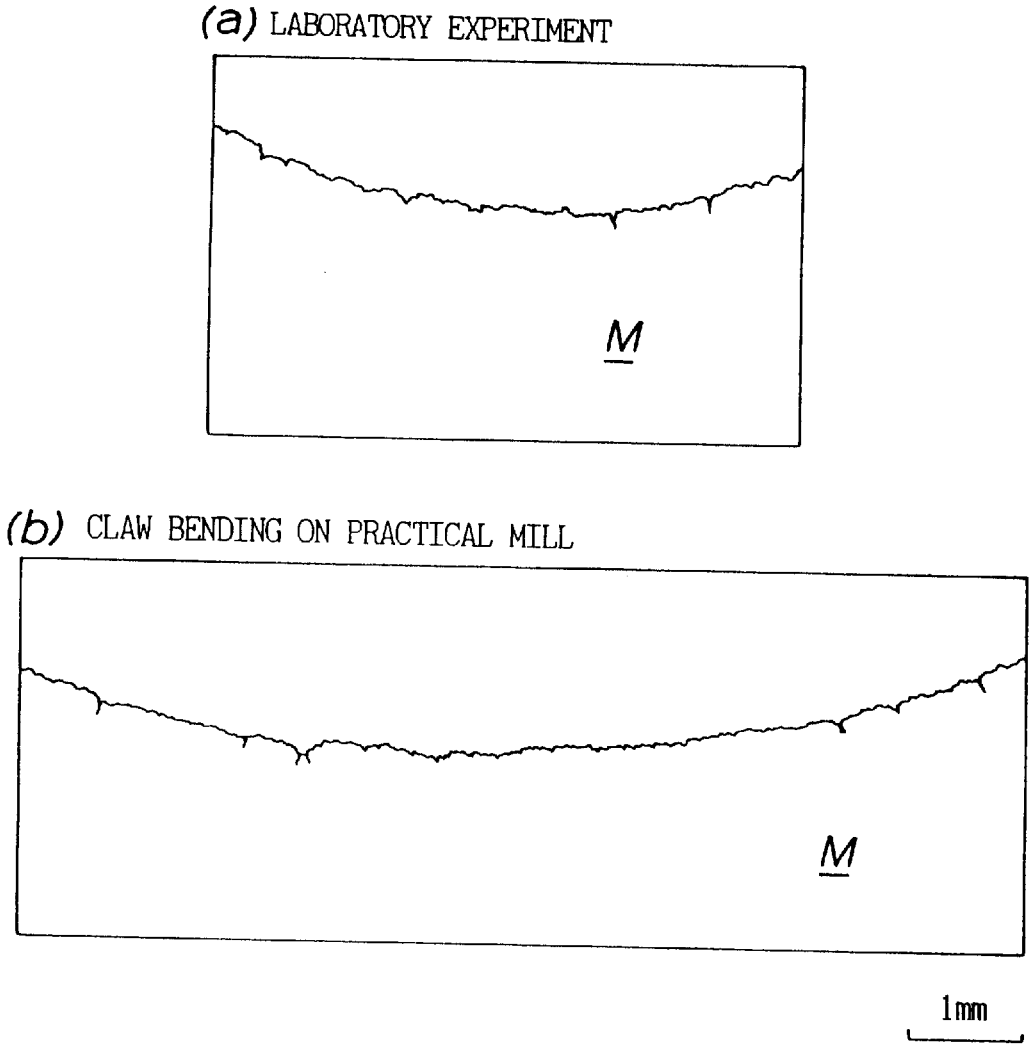
FIG. 9 is a sectional view comparatively illustrating properties of the non-constraint curved surface of claw bending between a laboratory experiment (a) and an industrial equipment (b)

The present inventors first studied a reproducing method for clarifying in a laboratory manner the wrinkle flaw occurring behavior during claw bending, and proposed as a result a laboratory experimental machine simulating claw bending on an industrial machine as shown in FIG. 8. In a three-point bending tester in which a test piece 7 supported by supporting seats 51 and 52 is pressed and bent by a punch 50 having a leading end R10 (having a radius of curvature of 10 mm) arranged between the both supporting seats 51 and 52, the laboratory experiment machine forms, on the test piece 7, a non-constraint inner curved surface similar to the inner surface of the curved claw on the commercial machine. According to this laboratory experiment machine, it is possible to reproduce wrinkles similar to those produced on an actual operating machine as shown in FIG. 9.

Using the above-mentioned laboratory experiment machine, a hot three-point bending test was carried out on sample representing the following three kinds of steel at various test piece temperatures (measuring points as shown in FIG. 8) to investigate the relationship between the bending start temperature and the wrinkle flaw depth (measured from a sectional microscopic image of the aforementioned non-constraint portion):

SM400 steel: 0.15%C-0.3%Si-0.6% Mn steel

SM490 steel: 0.15%C-0.3%Si-1.4% Mn-0.1%Cu-0.02%Nb-0.015% Ti steel

SM570 steel: 0.033%C-0.55%Si-1.55% Mn-0.052%Nb-0.015% Ti-0.0020% B steel

Figure 10:
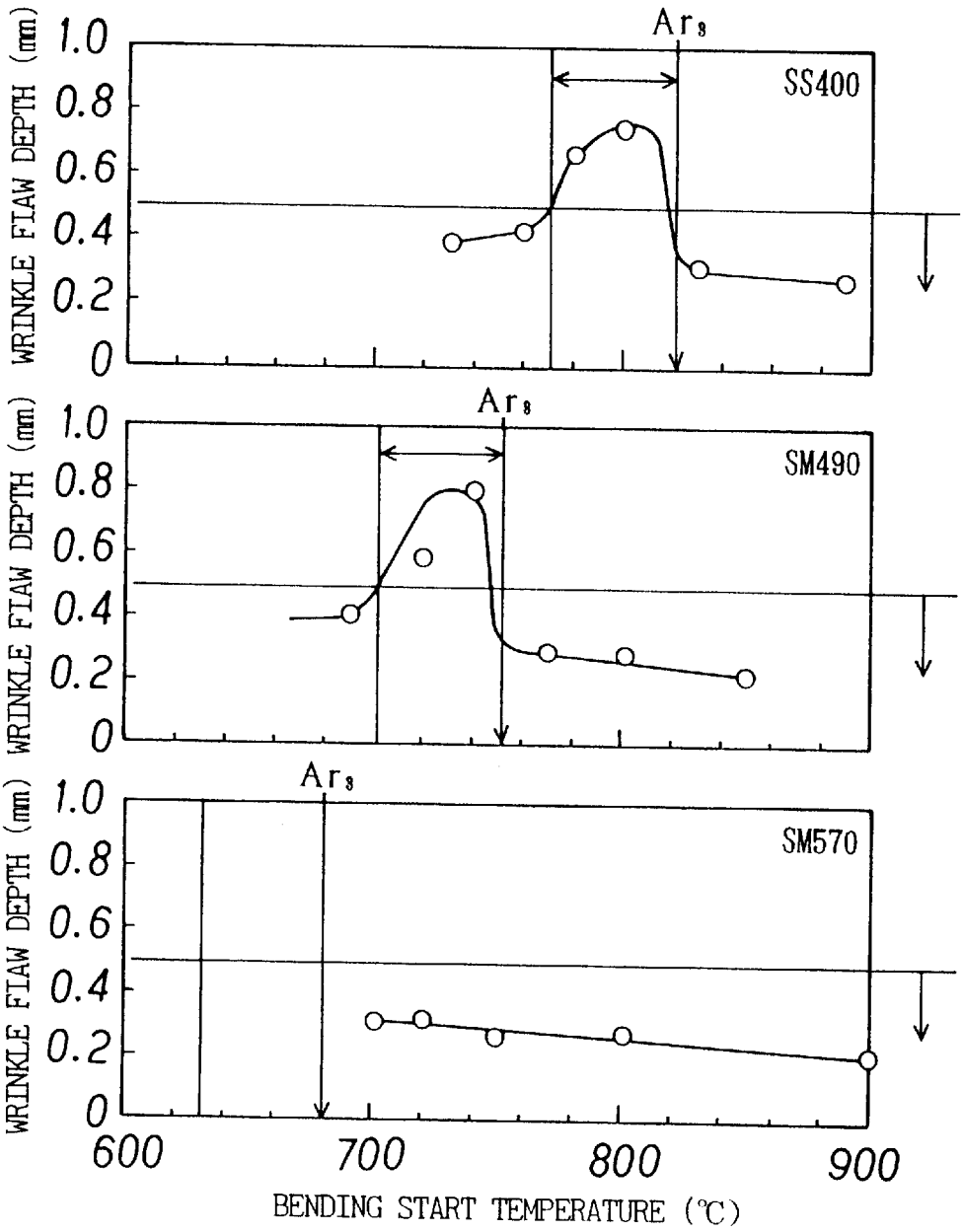
FIG. 10 is a graph illustrating the relationship between the bending start temperature and the wrinkle flaw depth.

The result is shown in FIG. 10. In SM400 steel, the wrinkle flaws are deepest when the bending start temperature is within a specific temperature region corresponding to a temperature region immediately below $Ar_3$ (up to $Ar_3$ and over $Ar_3$-50° C.) This specific temperature region moves toward the lower-temperature side in SM490 steel and SM570 steel in which the temperature corresponding to $Ar_3$ is lower. To judge from FIG. 10, in order to reduce the wrinkle flaw depth, the bending start temperature of the curved claw must be a temperature permitting avoidance of the above-mentioned specific temperature region, i.e., a temperature of over $Ar_3$ or $Ar_3$-50° C. or below.

The mechanism promoting wrinkle flaws within the above-mentioned specific temperature region is considered to be as follows.

Within the $\gamma$ (austenite)-region over $Ar_3$, there is no difference between the substrate surface and the interior thereof, so that the deformation resistance of the surface and the interior is dependent only on the temperature. The deformation resistance for the same structure is lower according as temperature is higher. Since temperature is lower on the surface than in the interior, deformation resistance is higher on the surface than in the interior, thus inhibiting development of surface wrinkles.

In the temperature region of up to $Ar_3$ and over $Ar_3$-50° C., the difference in structure between the surface and the interior is larger. In other words, while the interior remains to be of the single $\gamma$-phase, the surface presents a dual ($\gamma$+$\alpha$) phase partially containing $\alpha$ (ferrite)-phase giving a lower deformation resistance than $\gamma$. As a result, the relationship of the extent of deformation resistance between the surface and the interior becomes equal or even reversed, leading to easy development of wrinkles on the surface, resulting in deeper wrinkle flaws.

In the temperature region of up to $Ar_3$-50° C., the dual ($\gamma$+$\alpha$) phase transfers to the interior, and the portion between the point of this transfer and the surface is of the single $\alpha$-phase. Within this single $\alpha$-phase, deformation resistance is higher on the surface having a lower temperature than in the interior having a higher temperature. Therefore, growth of wrinkles on the surface is inhibited.

Figure 11:
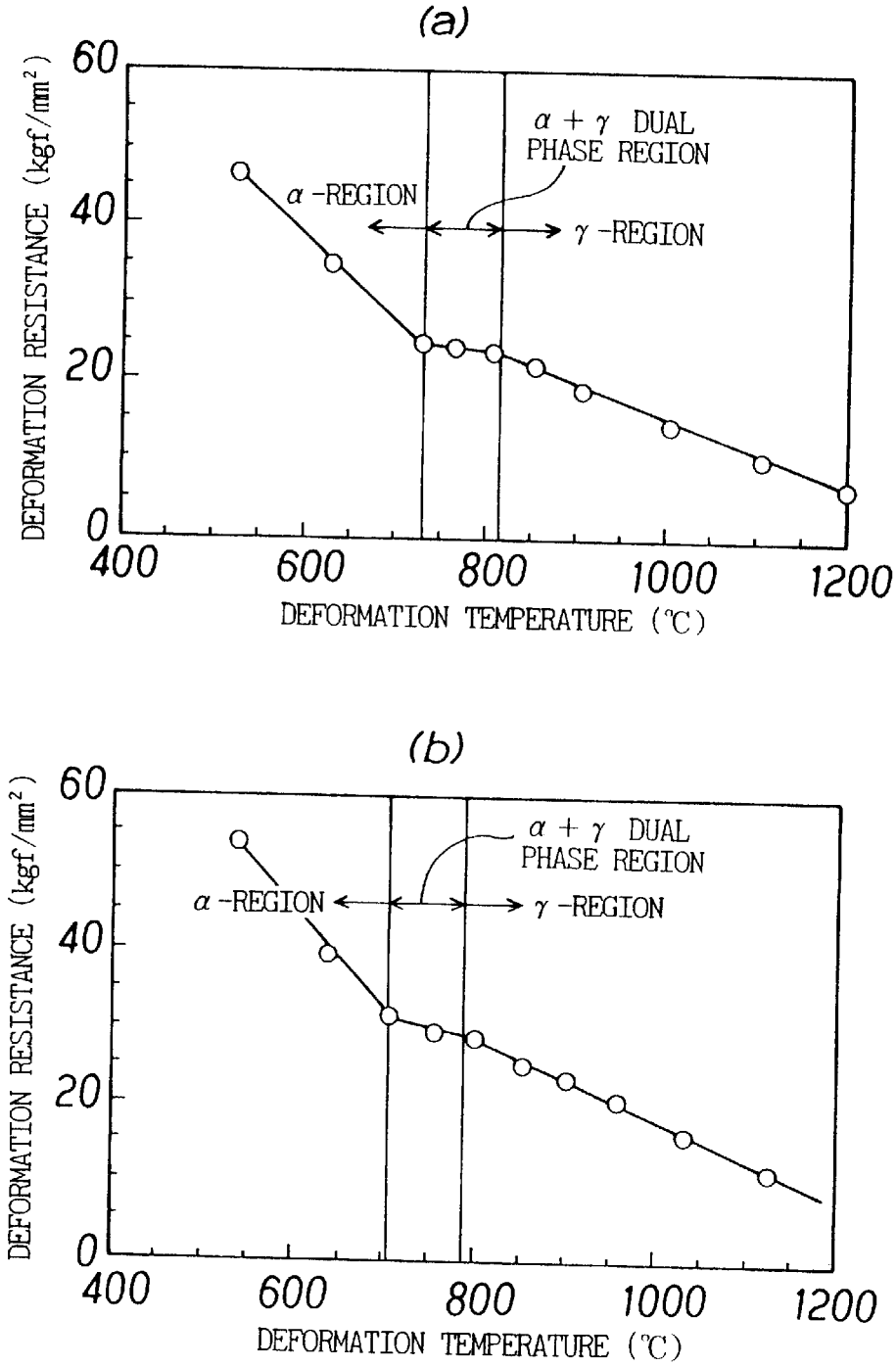
FIG. 11 is a schematic view illustrating temperature dependency of deformation resistance of steel.

Then, the claw bending end temperature was studied. FIG. 11 illustrates changes in deformation resistance in the case where, for the aforementioned 400 MPa-class steel and 490 MPa-class steel, cylindrical test pieces having a diameter of 8 mm and a height of 12 mm are sampled, and after heating to 1,200° C., are compressed by 50% at a prescribed temperature. FIG. 11 suggests that, for the both steel samples, deformation resistance suddenly increases according as temperature decreases to below 700° C. This sudden increase in deformation resistance makes it difficult to form the material into a target claw shape, makes it impossible to obtain a prescribed size or shape, and hence makes it difficult for joints to engage with each other. The claw bending end temperature should therefore preferably be 700° C. or more. The claw bending start temperature upon bending the claw should thus preferably avoid the range of up to $Ar_3$ and over $Ar_3$-50° C., and the bending end temperature, 700° C. or more.

Then, further reduction of the wrinkle flaw depth was studied. As a result, the possibility was found to further reduce wrinkle flaws by subjecting the flange outer surface of the section blank to a smoothing treatment in cold during the interval between the first and second steps of hot rolling.

Figure 12:
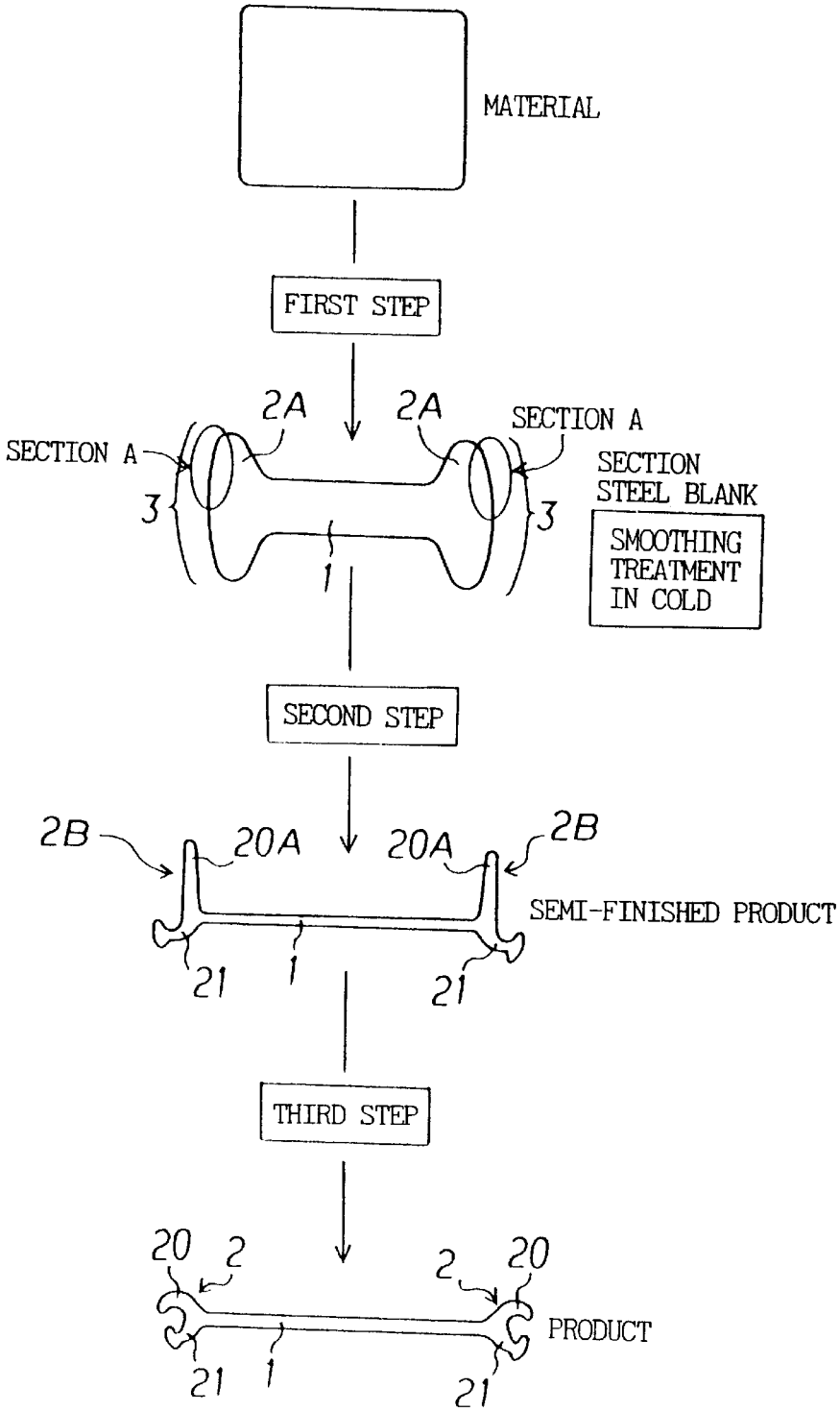
FIG. 12 is a process flowchart including the smoothing treatment.
Figure 13:
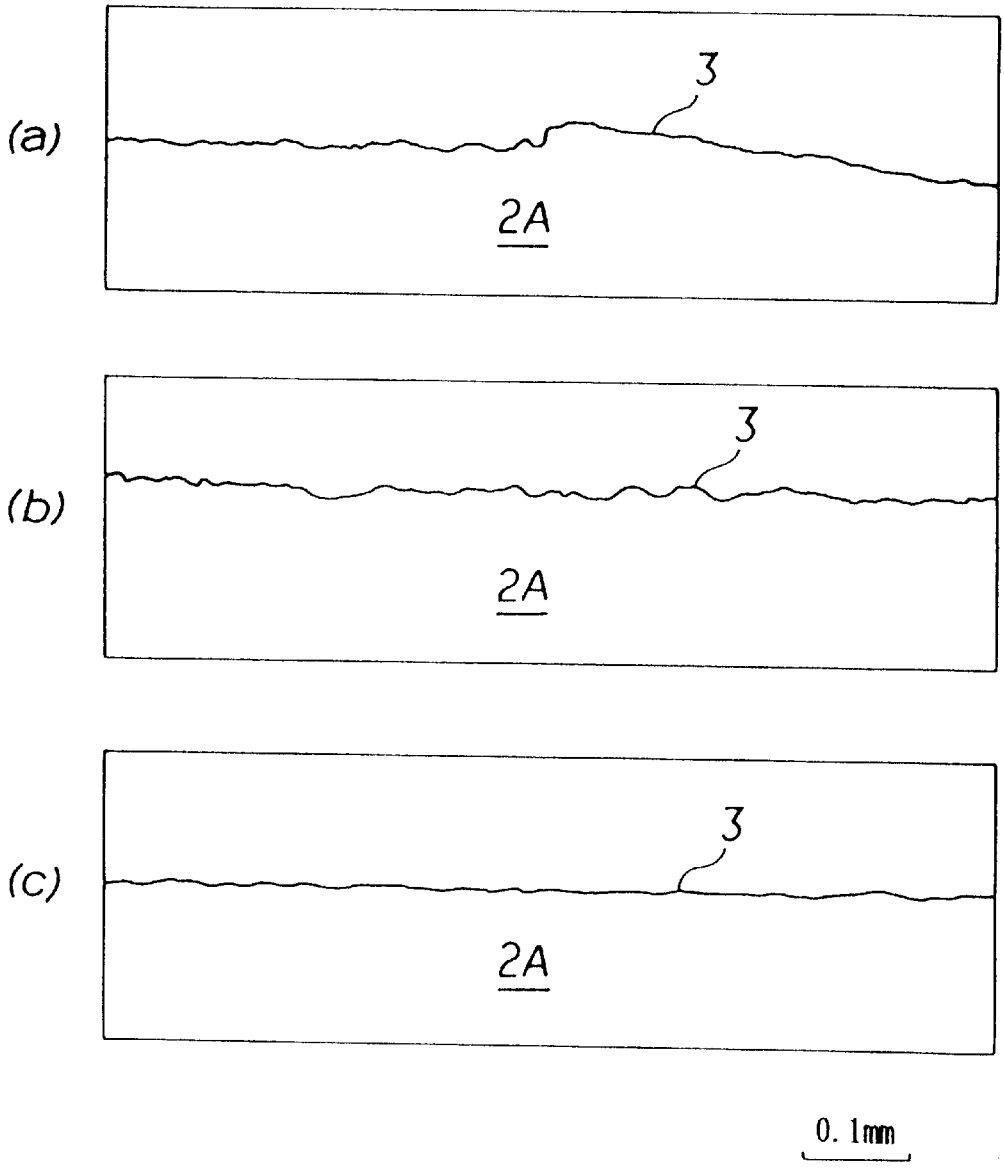
FIG. 13 is a sectional view illustrating a state of roughness of the flange surface of a section blank.

More specifically, as shown in FIG. 12, the first step is executed by a conventional method, and the outer surface 3 of the resultant section blank 1 is subjected to a smoothing treatment in cold (up to 100° C.). Subsequently, the second and third steps are sequentially carried out in a conventional manner. It is not always necessary to apply the smoothing treatment to the entire flange outer surface 3, but it suffices to cover a part (for example, section A in FIG. 12) corresponding to the inner surface of the curved claw 20 (outer surface of the projection 20A). FIG. 13 is a sectional view illustrating a roughened state of the flange outer surface of the section blank: (a) represents the case without a smoothing treatment; (b), the case of a smoothing treatment applied with a hot scarf (gas melting/grinding of a hot material); and (c), the case of a smoothing treatment applied with a cold scarf (gas melting/grinding of a cold material). Without a smoothing treatment, the surface is rough with irregularities of over 50 $\mu$m (FIG. 13(*a*)). When using a hot scarf, irregularities are reduced in depth to 10 to 30 $\mu$m but still present a rough state (FIG. 13(*b*)). With a cold scarf, in contrast, the surface becomes completely smooth like a mirror surface (FIG. 13(*c*)).

Figure 14:
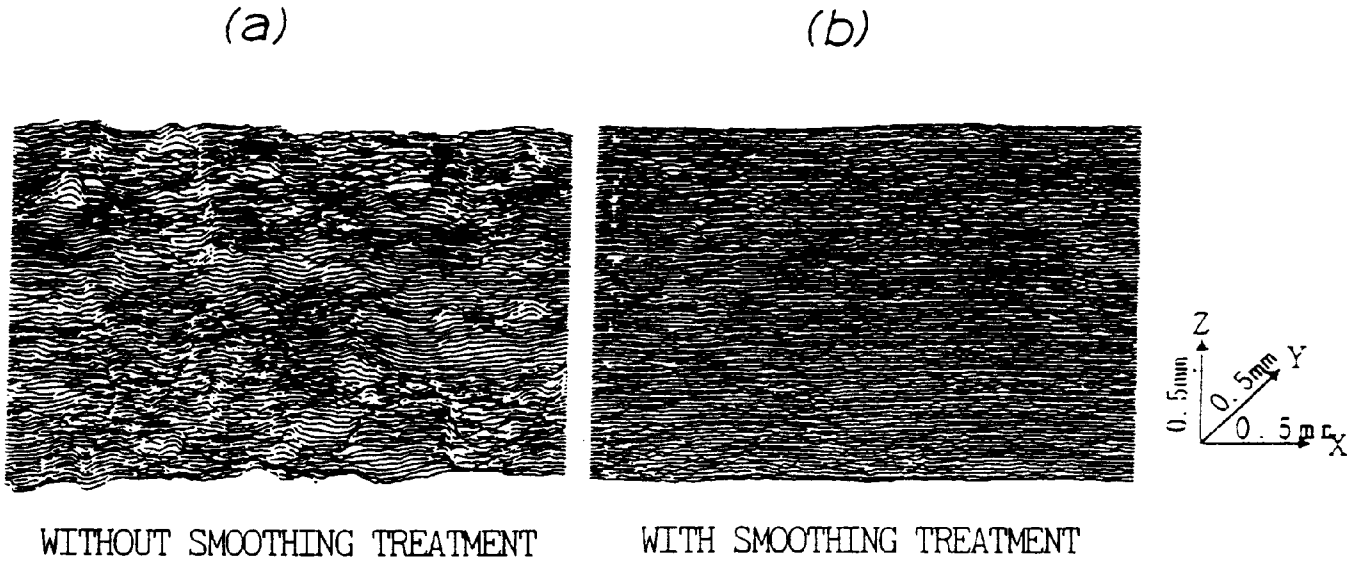
FIG. 14 is a surface profile drawing illustrating a state of roughness of the outer surface of a projection.

FIG. 14 is a profile drawing of surface roughness illustrating a rough state of the projection 20A outer surface: (a) represents the case without a smoothing treatment applied to the section blank flange outer surface; and (b), the case with a smoothing treatment applied with a cold scarf to the flange outer surface of the section blank. When the flange outer surface of the section blank is not subjected to a smoothing treatment, the projection outer surface exhibits a very rough state (FIG. 14(*a*)). Application of a smoothing treatment in cold to the flange outer surface of the section blank permits achievement of a very smooth state of the projection outer surface (FIG. 14(*b*)).

It is thus possible to make a smooth flange outer surface by applying the smoothing treatment in cold to the flange outer surface of the section blank during the interval between the first and second steps. This results in a very smooth state of the projection outer surface, which reduces occurrence sites of wrinkles upon claw bending. This alleviates wrinkle flaws on the inner surface of the curved claw, thus making it possible to obtain a product having excellent joint strength performance.

The smoothing treatment in cold should preferably be conducted so that the surface roughness Rmax of the smoothing-treated surface becomes 20 $\mu$m or less. This inhibits wrinkle flaws on the inner surface of the curved claw to a maximum depth of 0.3 mm or less, and enables to obtain a product having an excellent joint strength performance as typically represented by a fatigue life of at least 2 million cycles.

As means for smoothing treatment in cold, grinding with a grinder is applicable, apart from the use of a cold scarf. In grinding, however, it is difficult to reduce the surface roughness Rmax to below 20 $\mu$m. Use of the cold scarf is therefore preferable. With the cold scarf, it is possible to create an appropriate metal reflow state and obtain a finished surface smooth almost like a mirror surface. If a single run of cold scarfing is insufficient for smoothing, cold scarfing may be repeated twice or more.

EXAMPLE

Figure 2:
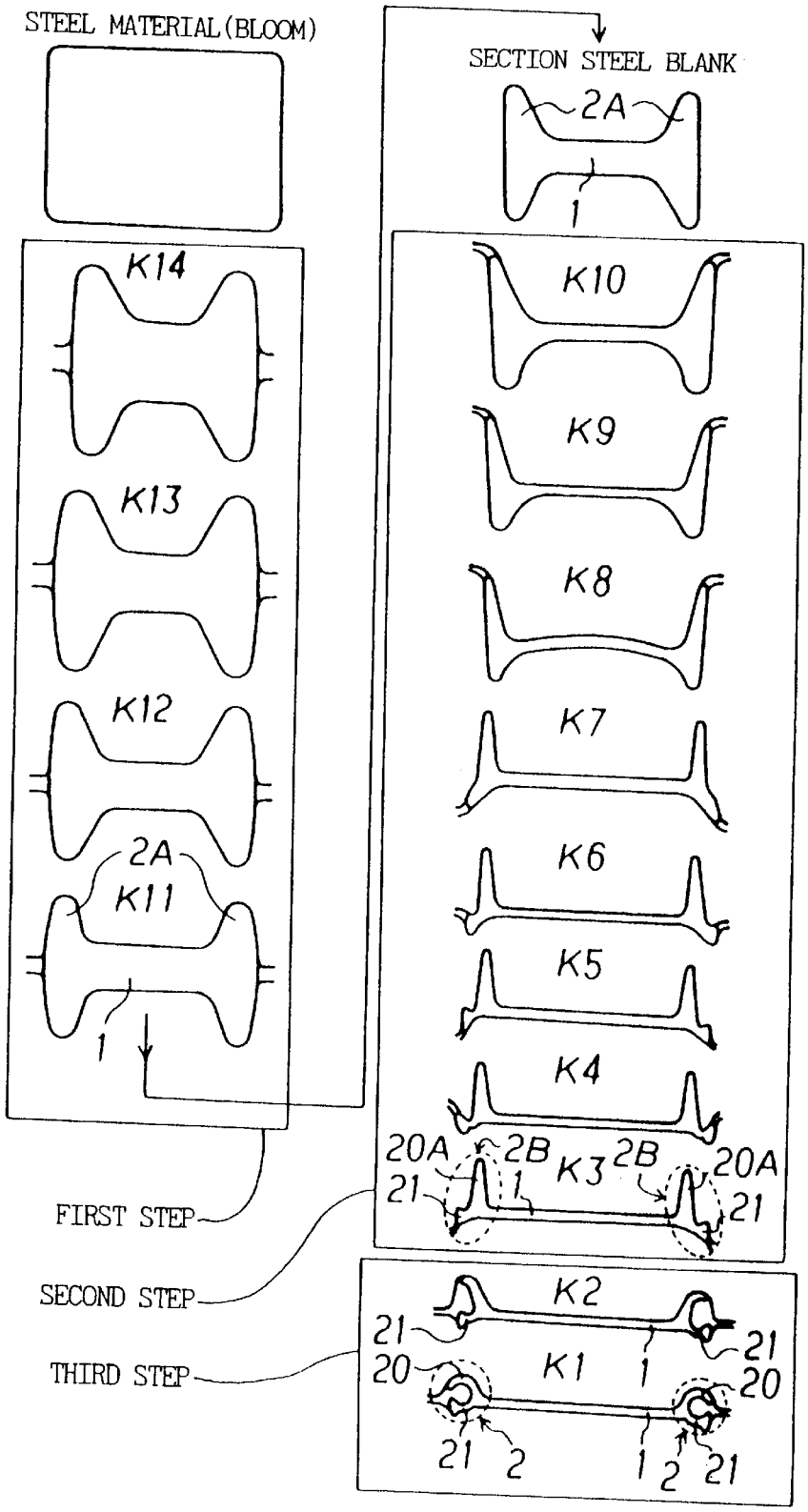
FIG. 2 is a caliber system diagram illustrating a typical caliber rolling process of the straight steel section.
Figure 3:
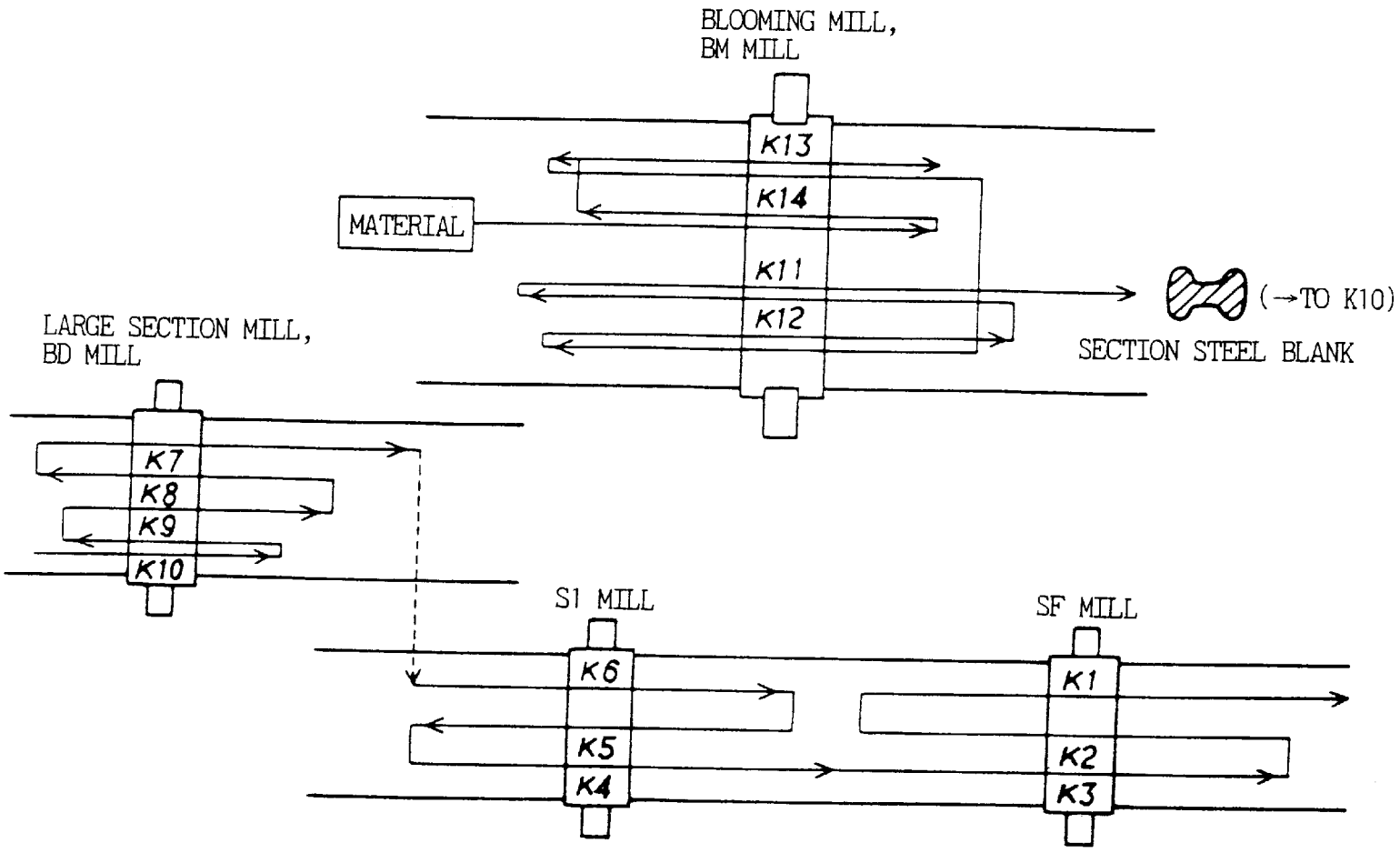
FIG. 3 is a layout drawing illustrating a typical caliber rolling equipment corresponding to FIG. 2.
Figure 4:
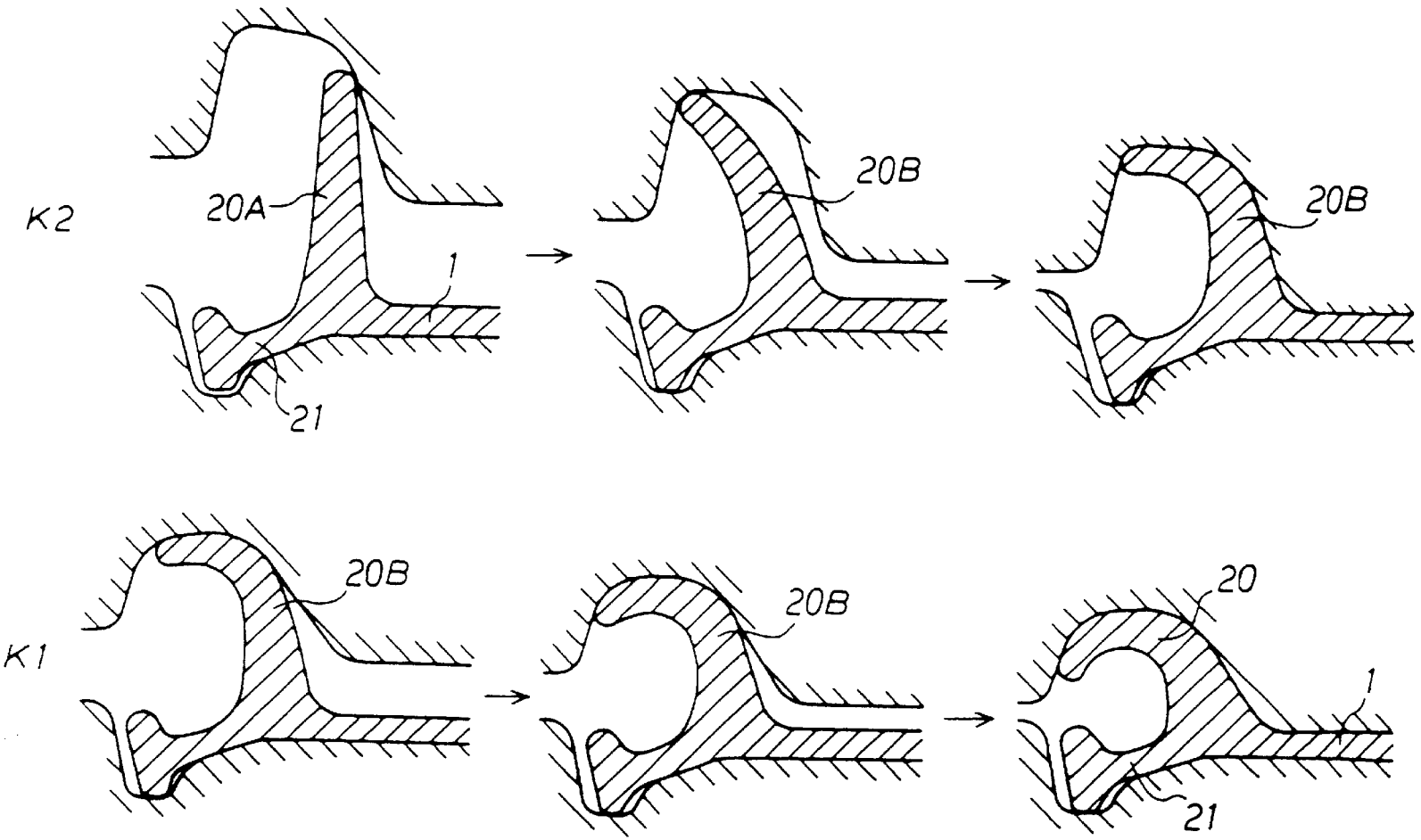
FIG. 4 is a partial sectional view illustrating a claw bending process through calibers K2 and K1.
Figure 5:
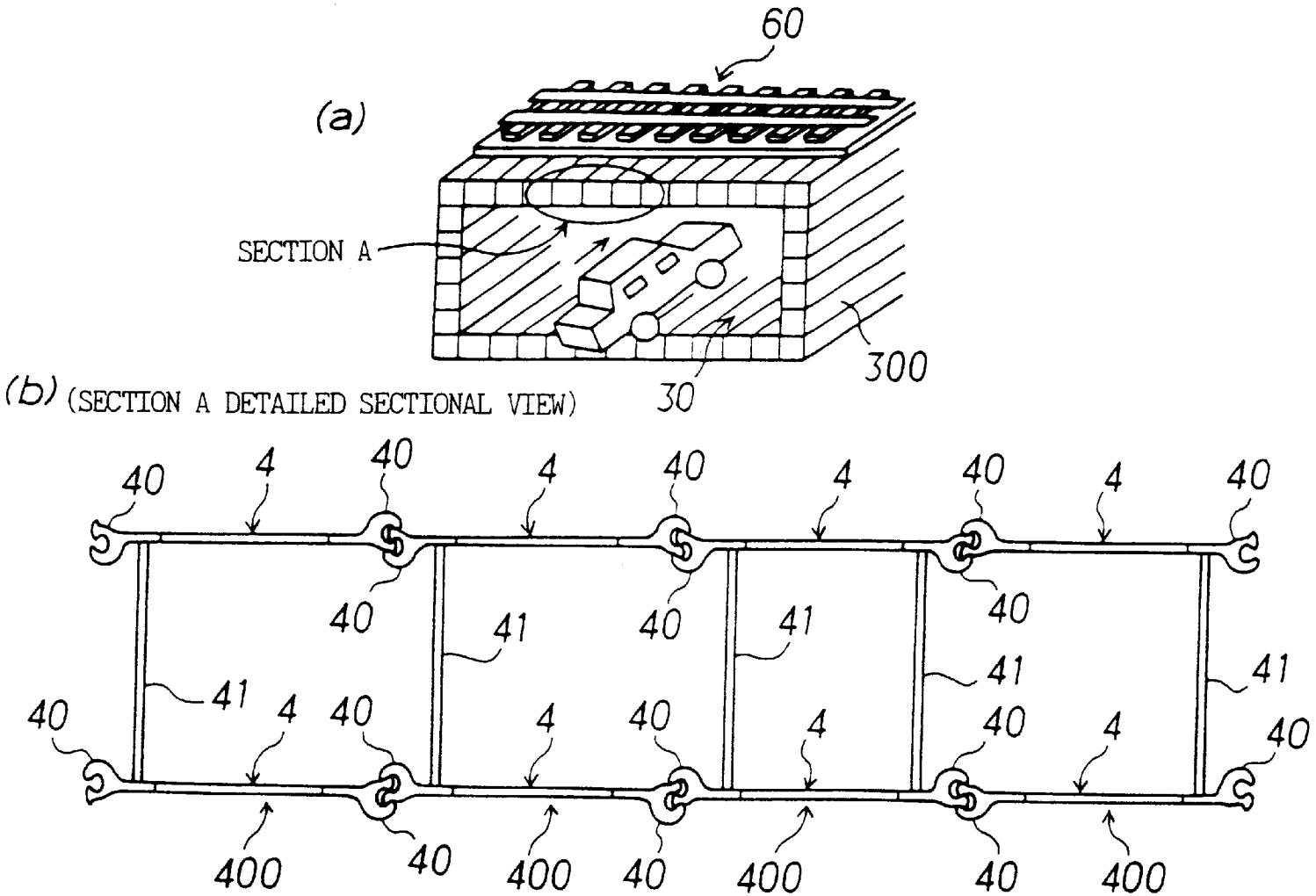
FIG. 5 is a descriptive view illustrating an outline of the JES process.
Figure 6:
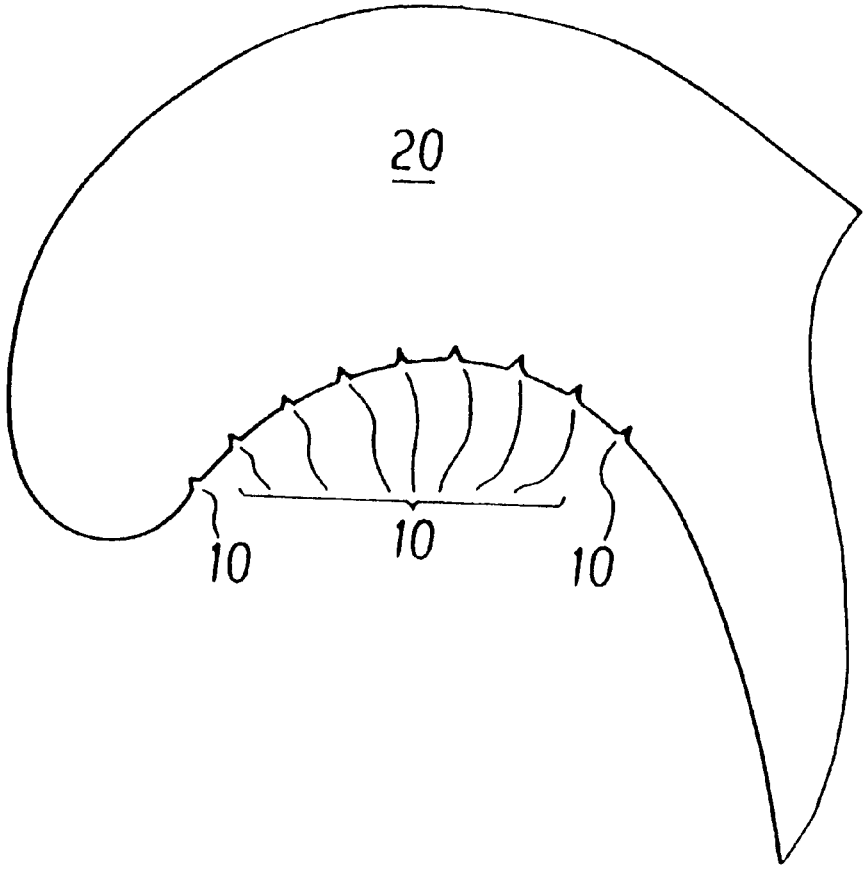
FIG. 6 is a partial sectional view illustrating wrinkle flaws produced on the inner surface of a curved claw.

A steel bloom having a chemical composition shown in Table 1 was hot-rolled by the manufacturing method shown in FIG. 2 under conditions shown in Table 2, and a straight steel section having a web of a thickness of 16 mm and a joint of a thickness of 21 mm, having a curved claw and a ball claw at the both ends of the web was manufactured.

The straight steel section was manufactured under various conditions including the bending start temperature and the bending end temperature of the curved claw in finish rolling, and the surface scarfing state of the bloom before finish rolling. In the third step for bending the projection into the curved claw, the baking is prevented and bending accuracy is not deteriorated by reducing the frictional coefficient upon bending. A lubricant mainly comprising a phosphoric acid ester is therefore sprayed as a pressure additive as mixed with water onto the formed portion. Any lubricant having a frictional coefficient upon forming within a range of from 0.15 to 0.25 may be applied, and among others, a phosphorus compound or a sulfur compound such as a sulfuric oil is suitably applicable.

For the resultant product, the depth of wrinkle flaws on the inner surface of the curved claw was measured, and mechanical properties of the web and joint fatigue property were investigated. The wrinkle flaw depth was observed and measured on ten cross-sections perpendicular to the rolling direction sampled at intervals of 100 mm in the rolling direction, and was evaluated in terms of maximum values of the measured data. Joints cut into lengths of 70 mm were engaged with each other, and fatigue test pieces were prepared by filling the connecting sections with mortar. Joint fatigue property was evaluated in terms of the number of repetition of application of stress load (fatigue life) until fatigue fracture by applying stress load onto the thus prepared fatigue test pieces under conditions including a load range of from 0 to 120 MPa and a loading cycle of 10 Hz.

Regarding mechanical properties, a #1B test piece specified in JIS Z 2201 was sampled in the rolling direction from the web (at ¼ the web height), and tensile strength and yield point (yield strength) were determined through a tensile test.

The result is shown in Table 2. In a straight steel section having scale flaws present with a depth of over 0.5 mm on the inner surface of the curved claw, the fatigue life is under a million cycles, suggesting a low fatigue property. On the other hand, the wrinkle flaw depth was reduced and the fatigue property was improved to a fatigue life of over a million cycles by adopting a higher curved claw bending start temperature, applying a scarf treatment to a depth of at least 2 mm to a portion of the bloom becoming the inner surface of the curved claw, or grinding the inner surface of the curved claw of the rolled straight steel section by a depth of 0.3 mm or more. Even without scarfing of the inner surface of the curved claw, an excellent fatigue property as represented by a fatigue life of over a million cycles was obtained only if the wrinkle flaw depth became under 0.5 mm. Particularly, a wrinkle flaw depth of under 0.3 mm resulted in a fatigue life of over 5 million cycles, which represents almost the fatigue limit, and no propagation of fatigue cracks was observed from wrinkle flaws.

By limiting the wrinkle flaw depth to 0.5 mm or less as described above, it is possible to manufacture straight steel sections of the TS400 MPa and higher classes excellent in fatigue property at a low cost through hot rolling of a high productivity.

TABLE 1

| STEEL | C % | Si % | Mn % | P % | S % | Al % | Cu % | Ni % | Cr % | Mo % | V % |
|---|---|---|---|---|---|---|---|---|---|---|---|
| A | 0.15 | 0.19 | 0.58 | 0.020 | 0.015 | — | — | — | — | — | — |
| B | 0.17 | 0.30 | 1.43 | 0.022 | 0.008 | — | — | — | — | — | — |
| C | 0.14 | 0.37 | 1.41 | 0.025 | 0.012 | 0.022 | 0.10 | — | — | — | — |
| D | 0.14 | 0.35 | 1.36 | 0.015 | 0.004 | — | 0.33 | 0.15 | — | — | — |
| E | 0.15 | 0.25 | 1.46 | 0.016 | 0.004 | — | — | — | — | — | 0.052 |
| F | 0.15 | 0.43 | 1.18 | 0.020 | 0.005 | 0.031 | — | — | — | — | — |
| G | 0.15 | 0.35 | 1.28 | 0.018 | 0.006 | — | — | — | — | — | — |
| H | 0.15 | 0.12 | 0.73 | 0.015 | 0.003 | — | — | — | — | — | — |
| I | 0.14 | 0.25 | 1.31 | 0.015 | 0.004 | 0.024 | 0.32 | 0.15 | — | — | 0.037 |
| J | 0.14 | 0.37 | 1.48 | 0.015 | 0.003 | 0.043 | 0.21 | — | — | — | — |
| K | 0.15 | 0.33 | 1.47 | 0.018 | 0.003 | — | 0.41 | 0.22 | — | — | — |
| L | 0.018 | 0.28 | 1.60 | 0.009 | 0.002 | — | 0.65 | 0.36 | — | — | — |
| M | 0.15 | 0.45 | 1.42 | 0.016 | 0.005 | 0.028 | 0.25 | 0.12 | — | — | — |
| N | 0.035 | 0.52 | 1.58 | 0.012 | 0.005 | 0.033 | — | — | — | — | — |
| O | 0.080 | 0.24 | 0.89 | 0.015 | 0.007 | 0.028 | 0.15 | 0.09 | 0.32 | 0.52 | 0.021 |

| STEEL | Nb % | Ti % | B % | REM % | Ca % | Ceq % | $Ar_3$ ° C. | REMARKS |
|---|---|---|---|---|---|---|---|---|
| A | — | — | — | — | — | 0.255 | 831 | BASE |
| B | — | — | — | — | — | 0.421 | 765 | BASE |
| C | 0.015 | — | — | — | — | 0.390 | 752 | STRENGTH |
| D | — | — | — | — | — | 0.385 | 770 | STRENGTH |
| E | — | — | — | — | — | 0.407 | 767 | STRENGTH |
| F | — | — | — | — | — | 0.365 | 792 | DEOXIDATION |
| G | — | 0.015 | — | — | — | 0.378 | 783 | HAZ |
| H | — | — | — | — | 0.003 | 0.277 | 818 | HAZ |
| I | — | — | — | — | — | 0.375 | 771 | DEOXIDATION, STRENGTH |
| J | 0.033 | — | — | — | — | 0.402 | 717 | DEOXIDATION, STRENGTH |
| K | — | 0.010 | — | 0.009 | — | 0.414 | 754 | HAZ, STRENGTH |
| L | 0.045 | 0.018 | 0.0020 | — | 0.002 | 0.305 | 697 | HAZ, STRENGTH |
| M | 0.014 | 0.012 | — | — | 0.003 | 0.408 | 745 | DEOXIDATION, STRENGTH, HAZ |
| N | 0.055 | 0.015 | 0.0020 | — | 0.002 | 0.320 | 707 | DEOXIDATION, STRENGTH, HAZ |
| O | 0.018 | 0.014 | — | 0.004 | — | 0.436 | 784 | DEOXIDATON, STRENGTH, HAZ |

TABLE 2

| No. | STEEL | $Ar_3$ ° C. | $Ar_3$ − 50 ° C. | WEB YS MPa | WEB TS MPa | CLAW BEND-ING START TEMP. ° C. | CLAW BEND-ING END TEMP. ° C. | FLANGE OUTER SUR-FACE REPAIR | QT. OF RE-PAIR mm | WRIN-KLE FLAW DEPTH mm | FATIGUE LIFE, IN UNITS OF 10,000 CYCLES | DIS-CRIMI-NATION | REMARKS |
|---|---|---|---|---|---|---|---|---|---|---|---|---|---|
| 1 | A | 831 | 781 | 299 | 449 | 765 | 735 | NONE | 0 | 0.25 | 280 | EXAMPLE | |
| 2 | A | 831 | 781 | 302 | 445 | 770 | 735 | IN COLD | 6 | 0.20 | >500 | EXAMPLE | |
| 3 | A | 831 | 781 | 295 | 440 | 855 | 800 | IN COLD | 6 | 0.30 | 240 | EXAMPLE | |
| 4 | A | 831 | 781 | 295 | 440 | 745 | 710 | NONE | 0 | 0.42 | 140 | EXAMPLE | |
| 5 | A | 831 | 781 | 287 | 433 | 775 | 740 | NONE | 0 | 0.68 | 24 | COMPARATIVE EXAMPLE | |
| 6 | A | 831 | 781 | 295 | 438 | 770 | 740 | NONE | 0 | 0 | >500 | EXAMPLE | INNER SURFACE OF CLAW POL-ISHED BY 0.8 mm |
| 7 | A | 765 | 715 | 301 | 450 | 710 | 675 | NONE | 0 | 0.28 | NOT TESTED | COMPARATIVE EXAMPLE | TARGET SHAPE NOT ACHIEVED |
| 8 | B | 765 | 715 | 331 | 526 | 850 | 790 | IN COLD | 4 | 0.37 | 253 | EXAMPLE | |
| 9 | B | 765 | 715 | 338 | 522 | 810 | 765 | IN HOT | 4 | 0.73 | 30 | COMPARATIVE EXAMPLE | |
| 10 | B | 765 | 715 | 342 | 520 | 820 | 770 | GRIND-ER | 4 | 0.83 | 16 | COMPARATIVE EXAMPLE | REPAIRED WITH #120 GRINDER IN PLACE OF SOL-VENT IN COLD |
| 11 | B | 765 | 715 | 358 | 524 | 765 | 725 | NONE | 2 | 0.62 | 33 | COMPARATIVE EXAMPLE | |
| 12 | B | 765 | 715 | 344 | 522 | 750 | 710 | IN COLD | 2 | 0.43 | 213 | EXAMPLE | |
| 13 | B | 765 | 715 | 348 | 525 | 850 | 810 | IN COLD | 6 | 0.22 | >500 | EXAMPLE | |
| 14 | C | 752 | 702 | 467 | 612 | 720 | 665 | NONE | 0 | 0.91 | NOT TESTED | COMPARATIVE EXAMPLE | TARGET SHAPE NOT ACHIEVED |
| 15 | D | 770 | 720 | 435 | 546 | 830 | 790 | NONE | 0 | 0.37 | 149 | EXAMPLE | |
| 16 | E | 767 | 717 | 430 | 541 | 820 | 770 | NONE | 0 | 0.35 | 182 | EXAMPLE | |

TABLE 2-continued

| No. | STEEL | $Ar_3$ ° C. | $Ar_3$ − 50 ° C. | WEB YS MPa | WEB TS MPa | CLAW BEND-ING START TEMP. ° C. | CLAW BEND-ING END TEMP. ° C. | FLANGE OUTER SUR-FACE REPAIR | QT. OF RE-PAIR mm | WRIN-KLE FLAW DEPTH mm | FATIGUE LIFE, IN UNITS OF 10,000 CYCLES | DIS-CRIMI-NATION | REMARKS |
|---|---|---|---|---|---|---|---|---|---|---|---|---|---|
| 17 | F | 792 | 742 | 364 | 504 | 735 | 705 | IN COLD | 4 | 0.34 | 215 | EXAMPLE | |
| 18 | F | 792 | 742 | 360 | 490 | 770 | 735 | NONE | 0 | 0.76 | 30 | COMPARATIVE EXAMPLE | |
| 19 | G | 783 | 733 | 357 | 509 | 800 | 765 | IN COLD | 4 | 0.38 | 272 | EXAMPLE | |
| 20 | G | 783 | 733 | 402 | 509 | 730 | 700 | IN COLD | 4 | 0.46 | 201 | EXAMPLE | |
| 21 | H | 818 | 768 | 289 | 457 | 760 | 725 | IN COLD | 4 | 0.33 | 200 | EXAMPLE | |
| 22 | I | 771 | 721 | 433 | 543 | 830 | 790 | IN COLD | 4 | 0.30 | 302 | EXAMPLE | |
| 23 | J | 717 | 667 | 470 | 583 | 800 | 755 | IN COLD | 4 | 0.35 | 143 | EXAMPLE | |
| 24 | K | 754 | 704 | 452 | 563 | 825 | 780 | IN COLD | 4 | 0.25 | >500 | EXAMPLE | |
| 25 | L | 697 | 647 | 493 | 668 | 815 | 765 | IN COLD | 4 | 0.35 | 122 | EXAMPLE | |
| 26 | M | 745 | 695 | 422 | 568 | 800 | 760 | IN COLD | 4 | 0.38 | 253 | EXAMPLE | |
| 27 | N | 707 | 657 | 457 | 635 | 830 | 795 | IN COLD | 4 | 0.30 | 328 | EXAMPLE | |
| 28 | O | 784 | 734 | 428 | 557 | 830 | 785 | IN COLD | 2 | 0.38 | 257 | EXAMPLE | |

INDUSTRIAL APPLICABILITY

According to the present invention, it is possible to efficiently manufacture a straight steel section having a high strength and an excellent fatigue property (connecting section fatigue property) suitable as a material for elements of a frame structure constructed when building a road under a railroad, and particularly, it is possible to effectively reduce wrinkle flaws on the inner surface of the curved claw by inserting a cold smoothing step in the upstream of the rolling manufacturing step. There is thus available an excellent effect of permitting inexpensive quantity supply by hot rolling forming.

What is claimed is:

1. A straight steel section excellent in joint fatigue property, having a joint comprising a flat web and a ball claw and a curved claw at the both ends in the width direction thereof, wherein wrinkle flaws present on the inner surface of said curved claw have a depth of 0.5 mm or less.

2. A straight steel section excellent in joint fatigue according to claim 1, having a chemical composition comprising, in mass percentage, from 0.01 to 0.20% C, 0.8% or less of Si, 1.8% or less of Mn, 0.030% or less of P, and 0.020% or less of S, and the balance Fe and incidental impurities.

3. A straight steel section excellent in joint fatigue property according to claim 1, having a chemical composition comprising, in mass percentage, from 0.01 to 0.20% C, 0.8% or less of Si, 1.8% or less of Mn, 0.030% or less of P, and 0.020% or less of S, and in addition, one or more selected from the following groups 1 to 3:

(group 1) one or more selected from the group consisting of 1.0% or less of Cu, 1.0% or less of Ni, 1.0% or less of Cr, 0.5% or less of Mo, 0.10% or less of V, 0.10% or less of Nb, and 0.005% or less of B;

(group 2) 0.1% or less of Al; and (group 3) one or more selected from the group consisting of 0.10% or less of Ti, 0.010% or less of Ca, and 0.010% or less of REM, and the balance Fe and incidental impurities; wherein the carbon equivalent Ceq defined by the following formula (1)

$$Ceq=C+Se/24+Mn/6+Ni/40+Cr/5+Mo/4+V/14 \quad (1)$$

where each of element symbols on the right side: content of the element (mass %) is 0.45% or less.

4. A straight steel section excellent in joint fatigue property according to claim 1, which is used in a tunnel wall frame member for constructing a road under a railroad.

* * * * *